US009925788B2

(12) United States Patent
Morrison

(10) Patent No.: US 9,925,788 B2
(45) Date of Patent: Mar. 27, 2018

(54) METHODS AND APPARATUS TO PRIME A PRINTHEAD ASSEMBLY

(71) Applicant: HEWLETT-PACKARD DEVELOPMENT COMPANY, L.P., Houston, TX (US)

(72) Inventor: Randal J. Morrison, Vancouver, WA (US)

(73) Assignee: Hewlett-Packard Development Company L.P., Houston, TX (US)

( * ) Notice: Subject to any disclaimer, the term of this patent is extended or adjusted under 35 U.S.C. 154(b) by 0 days.

(21) Appl. No.: 15/119,107

(22) PCT Filed: Feb. 13, 2014

(86) PCT No.: PCT/US2014/016263
§ 371 (c)(1),
(2) Date: Aug. 15, 2016

(87) PCT Pub. No.: WO2015/122897
PCT Pub. Date: Aug. 20, 2015

(65) Prior Publication Data
US 2017/0036453 A1 Feb. 9, 2017

(51) Int. Cl.
*B41J 2/19* (2006.01)
*B41J 2/175* (2006.01)
(Continued)

(52) U.S. Cl.
CPC ..... *B41J 2/17596* (2013.01); *B41J 2/1652* (2013.01); *B41J 2/175* (2013.01);
(Continued)

(58) Field of Classification Search
CPC ..... B41J 2/17596; B41J 2/19; B41J 2/1652; B41J 2202/07; B41J 2002/16597; B41J 2002/16594; F04B 37/14; F04B 49/20
See application file for complete search history.

(56) References Cited

U.S. PATENT DOCUMENTS 6,220,699 B1 4/2001 Taylor et al.
6,450,609 B1 9/2002 Premnath et al.
(Continued)

FOREIGN PATENT DOCUMENTS

WO WO-2009145758 12/2009

OTHER PUBLICATIONS http://ieeexplore.ieee.org/xpl/articleDetails.jsp?tp=&arnumber=5349802&queryText%3DDynamics+of+entrained+air+bubbles+inside+a+piezodriven+inkjet+printhead >Author: Sang, J.L.

*Primary Examiner* — Geoffrey Mruk
(74) *Attorney, Agent, or Firm* — HP Inc. Patent Department

(57) ABSTRACT

Methods and apparatus to prime a printhead assembly are disclosed. An example method includes drawing ink into a printhead assembly by operating a pump in fluid communication with the printhead assembly for a first period of time at a first speed. An amount of ink drawn into the printhead assembly during the first period is to be sufficient to cover nozzles of a die at an outlet of the printhead assembly. The example method further includes evacuating air within the printhead assembly by operating the pump for a second period of time after the first period of time at a second speed greater than the first speed.

19 Claims, 10 Drawing Sheets

(51) Int. Cl.

| | |
|---|---|
| ***B41J 2/165*** | (2006.01) |
| ***F04B 37/14*** | (2006.01) |
| ***F04B 49/20*** | (2006.01) |

(52) U.S. Cl.

CPC ..... *B41J 2/1752* (2013.01); *B41J 2/17513* (2013.01); *B41J 2/17553* (2013.01); *B41J 2/19* (2013.01); *F04B 37/14* (2013.01); *F04B 49/20* (2013.01); *B41J 2002/16594* (2013.01); *B41J 2002/16597* (2013.01); *B41J 2202/07* (2013.01)

(56) References Cited

U.S. PATENT DOCUMENTS

| | | | | |
|---|---|---|---|---|
| 6,523,931 | B1 | 2/2003 | Cipolla et al. | |
| 7,543,907 | B2 | 6/2009 | Harada et al. | |
| 2003/0043225 | A1 | 3/2003 | Cipolla et al. | |
| 2007/0182779 | A1 * | 8/2007 | Iwasaki ..... | B41J 2/16532 347/30 |
| 2009/0237424 | A1 | 9/2009 | Martin et al. | |
| 2013/0076809 | A1 | 3/2013 | Gonzales et al. | |
| 2013/0233418 | A1 | 9/2013 | Aldrich et al. | |
| 2013/0343938 | A1 | 12/2013 | Hutchison et al. | |

* cited by examiner

METHODS AND APPARATUS TO PRIME A PRINTHEAD ASSEMBLY

BACKGROUND

Some imaging devices capable of printing images upon paper and/or other media use an ink provided via one or more individual ink cartridges (IICs) coupled to, for example, a printhead assembly. In some examples, before such imaging devices can function properly the printhead assembly must be primed by evacuating air from the printhead assembly and drawing ink therein.

DETAILED DESCRIPTION

Figure 1:
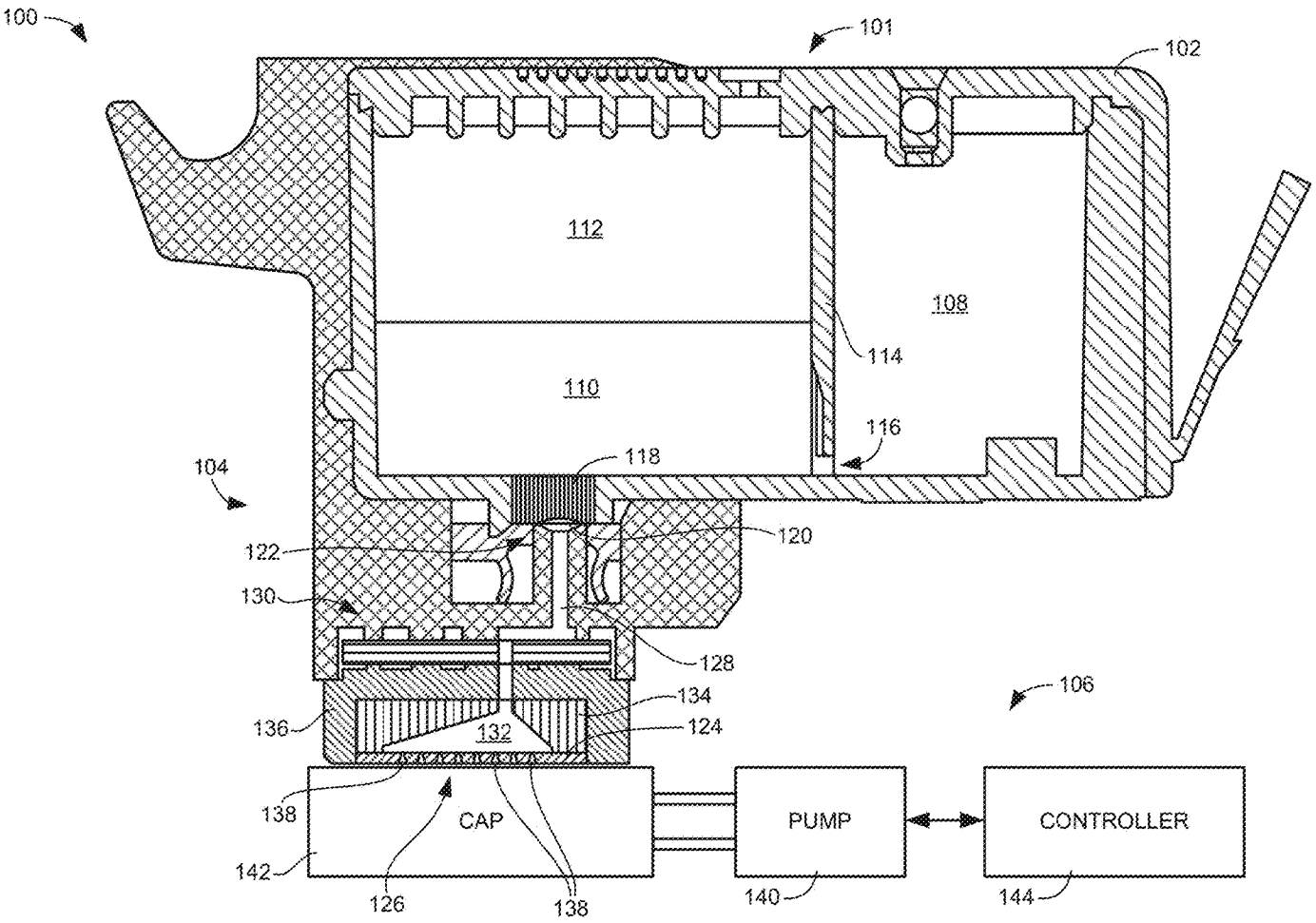
FIG. 1 illustrates an example ink delivery system that may be implemented in a printer or other imaging device.

Typically, the printhead assembly (PHA) of a newly manufactured imaging device (e.g., an out-of-the-box printer) that uses individual ink cartridge (IIC) technology will be filled with air rather than ink. However, to properly operate such an imaging device, the air within the PHA must first be evacuated and replaced with ink from one or more IICs installed into the PHA. Such a process is referred to as priming the PHA. In addition to the initial priming of a newly manufactured imaging device, during the normal operation of such a device air may develop within the PHA. Accordingly, imaging devices undergo periodic priming to remove any air that may have developed within the PHA to reduce the degradation of print quality over time.

The priming of a PHA often involves depressurizing the PHA via a pump coupled to an outlet of the PHA to begin evacuating air within the PHA and to suck or draw in ink from an IIC coupled to an inlet of the PHA. While the pump can evacuate some of the air by reducing the pressure in the PHA, the majority of the air is expelled from the PHA because it is pushed or carried out by the ink being drawn into and through the PHA. That is, as the pump draws ink into and through the PHA, the ink will carry out air from within the PHA until most (e.g., all or substantially all) of the air is evacuated. Achieving such a two-phase flow (e.g., flow of both liquid and gas (e.g., ink and air)) through the PHA depends upon the pressure (or vacuum) created by the pump, the fluid properties of the ink, and the particular characteristics of the components of the PHA through which the air and ink must pass. In particular, the flow rate of the ink through the PHA needs to be sufficient to overcome buoyancy forces causing air bubbles to rise through the fluid path of the PHA away from the bottom of the PHA where the outlet is located. Further, the flow rate of the ink needs to be sufficient to detach air bubbles from the walls of the fluid path of the PHA. Additionally, the total amount of ink (or the duration of the prime) needs to be long enough to move air bubbles from the inlet of the PHA through the entire fluid path of the PHA and out the outlet.

Additionally, the fluid path of the PHA is typically terminated (e.g., at the outlet) by a die containing small nozzles through which the ink is forced during a printing process. Additionally, during a priming process the air within the PHA, along with ink, are forced through the die (via the nozzles) to evacuate the air. The nozzles sufficiently small to retain ink within the PHA until it is forced through the nozzles by, for example, a pressure difference across the die. That is, if a vacuum is applied to the outside of the die while ink is on the inside, a resulting pressure difference across the die created by the vacuum will force the ink through the die. The size of the nozzles in the die are such that the die functions like a membrane in that, when the nozzles are impregnated with ink, at certain pressure differentials across the die, ink will pass through the nozzles while any air within the PHA will not be able to pass through the nozzles. That is, while a relatively low vacuum on the outlet side will pull ink through the nozzles, any air within the PHA will remain inside the PHA. As such, to effectively evacuate the air from the PHA, the priming (vacuum) pressure generated by the pump that acts on the die needs to be sufficient to draw both ink and air (e.g., to establish two-phase flow) through the die nozzles. The desired level of vacuum acting on the die to draw both ink and air through the die depends upon the relative pressure (level of vacuum) on the side of the die inside the PHA. That is, the difference in pressure or pressure differential across the die must exceed a threshold level before both ink and air will be drawn through the die. This threshold pressure difference is referred to herein as the bubble pressure of the die and is a function of the physical properties of the die (e.g., porosity) and of the ink (e.g., viscosity). The term "vacuum" as used herein refers to a condition of reduced pressure relative to some reference pressure (e.g., atmospheric pressure). Thus, "vacuum" and "partial vacuum" are synonymous as used herein. Further, as used herein, an "increase" in vacuum is associated with a corresponding "decrease" or "reduction" in pressure. Likewise, a "higher" vacuum relative to some other vacuum (or pressure), as used herein, corresponds with a "lower" pressure relative to the other vacuum (or pressure).

Furthermore, before air can be drawn out through the die, the air within the PHA needs to be brought down to the die. Accordingly, the force of the vacuum must also be sufficient to generate a flow rate of the ink that is strong enough to detach or dislodge air bubbles along the fluid path of the PHA and carry the bubbles down to the die. In some examples, the level of vacuum sufficient to draw air through the nozzles of the die is also sufficient to generate the desired flow rate of the ink. In other examples, the vacuum generated by the pump is increased beyond the level needed to draw air out through the die to ensure a sufficient flow rate to actually force all air bubbles down to the die.

While a die is typically situated at an outlet of a PHA, the inlet of the PHA is defined by a filter configured to engage a wick of an IIC. Both the filter and the wick have corresponding bubble pressures defining threshold pressure differences above which two-phase flow (e.g., both ink and air) will begin passing through the corresponding filter or wick. Thus, while it is desirable to generate a pressure difference across the die that exceeds the die bubble pressure to evacuate air from within the PHA, it is desirable to keep the pressure difference across the filter and wick below their corresponding bubble pressures. Otherwise, additional air may be drawn into the PHA, which is counter-productive to the priming process. Typically, a vacuum at the outlet of the PHA will be greater than a vacuum at the inlet of the PHA due to dynamic losses between the outlet and the inlet and pressure drops caused by ink in the PHA. In this manner, the relatively high level of vacuum desired at the die can be generated by the pump while a much lower level of vacuum desired at the filter will reduce (e.g., avoid) air being drawn into the PHA. However, drawing in additional air via the inlet of the PHA is a much greater concern when priming an unused or new PHA (e.g., a newly manufactured PHA) than when priming or re-priming a PHA that already contains some ink.

The difficulty in priming an unused PHA arises due to the PHA being completely dry with no ink in the fluid path of the PHA. Without ink in the PHA, there is an open channel from the pump (coupled to the outlet of the PHA) through the nozzles of the die and up through the fluid path to the interface of the filter of the PHA and the wick of the ink cartridge (at the inlet of the PHA). As a result, there is almost no pressure difference across the die and negligible dynamic pressure losses along the fluid path such that the pressure (vacuum) acting on the die (at the outlet) of the PHA is substantially the same as the pressure (vacuum) within the PHA. As a result, the pressure (vacuum) acting on the outlet is substantially the same pressure (vacuum) acting on the inlet of the PHA (e.g., on the filter). That is, a dry PHA transmits nearly all priming (vacuum) pressure from the pump directly through to the ink supply at the inlet of the PHA. In such circumstances, the low pressure needed at the PHA outlet to overcome the die bubble pressure (to withdraw air from the PHA) will pass through to the PHA inlet to also overcome the bubble pressure of the filter and/or the wick thereby resulting in additional air being pulled into the PHA.

Once at least some ink has entered the PHA and reaches the die (e.g., in a previously used and/or primed PHA), the ink covers the nozzles of the die, thereby closing off the open, dry path for air between the pump coupled to the outlet and the filter and wick at the inlet. As a result, the ink creates a significant pressure difference across the die such that the pressure within the PHA will be much higher than the pressure (generated by the pump) at the die. In other words, the vacuum at the inlet will be much less than the vacuum at the outlet. In this manner, the pressure (vacuum) acting on the die can be low enough to draw out the air in the PHA (e.g., create a pressure difference across the die that exceeds the die bubble pressure). At the same time, the pressure within the PHA can be high enough to reduce (e.g., avoid) drawing air into the PHA (e.g., create a pressure difference that remains below the filter and/or wick bubble pressure(s)) but still low enough to draw ink into the PHA.

In the past, the challenges presented by initially priming an unused (e.g., dry) PHA have been overcome by implementing a series of priming processes. In some past processes, a first prime of the PHA will draw in some ink but also pull in a lot of air. With some ink in the PHA, a second prime will be more effective in drawing out air without drawing in additional air. In some past processes, a third prime of the PHA has been found necessary to completely remove the air from within the PHA and fill it with ink. While the end result of the above old approach ultimately achieves the desired goal of a primed PHA, the approach takes a significant period of time and produces much noise during that period; both of which can be frustrating and/or annoying to end users. Furthermore, the multiple iterations implemented to prime the PHA of known methods result in more ink being used in the priming process, which leaves less ink for end users to use in printing.

To overcome the above problems, examples disclosed herein implement a single prime with a unique pressure profile that adjusts the pressure (vacuum) created by the pump to different levels at respective different stages of the priming process to effectively evacuate air in a PHA in a shorter amount of time. Examples disclosed herein reduce (e.g., eliminate) repetitive processes, thereby reducing the total amount of noise created and reducing the amount of ink wasted. In some disclosed examples, the pressure profile employed has a shape generally resembling a boot where, during a first period (e.g., a toe of the boot), a small reduction in pressure (e.g., a relatively slight vacuum) is generated by the pump. Because the PHA is completely dry initially, the slight vacuum is applied directly to the ink supply (at the inlet of the PHA) to draw ink into the PHA because there is no pressure difference across the die created from ink in the PHA. The reduction in pressure is small enough such that the resulting vacuum within the PHA is insufficient to draw air into the PHA.

In some disclosed examples, the first period of the pressure profile described above ends when a sufficient amount of ink has been drawn into the PHA to wet out the die (e.g., impregnate the die nozzles with ink). In some examples, during the second period of the pressure profile (e.g., the leg of the boot), the pump runs at a much higher rate to significantly lower the pressure (e.g., the resulting vacuum is significantly increased) to a point sufficient to draw both ink and air out through the die thereby evacuating the air within the PHA. Due to the ink previously drawn into the PHA during the first period of the disclosed example pressure profile, the resulting pressure difference across the die prevents the significantly higher vacuum generated by the pump during the second period from acting directly on the filter of the PHA. As a result, air is not drawn into the PHA. In some disclosed examples, the significantly reduced pressure (e.g., the higher vacuum) is maintained for a period of time to allow all or substantially all air within the PHA to be drawn out.

FIG. 1 illustrates an example imaging system 100 that may be implemented in a printer or other imaging device. The example imaging system 100 includes an example ink cartridge 102, an example printhead assembly (PHA) 104, and an example service station 106. The example ink cartridge 102 and the example PHA 104 are referred to herein collectively as an ink delivery system 101 of the example imaging system 100.

In the illustrated example, the example ink cartridge 102 defines a free ink chamber 108, a high capillarity media 110, and a low capillarity media 112. In some examples, the high and low capillarity media 110, 112 contain foam or some other media with differing degrees of capillary properties. In the illustrated example, the high and low capillarity media 110, 112 are separated from the free ink chamber 108 via a wall 114. In some such examples, the wall 114 includes a bubbler 116 to place the free ink chamber 108 in fluid communication with one or both of the high and low capillarity media 110, 112. The fluid communication may be direct (e.g., the high capillarity media 110 engages the bubbler 116) or it may be indirect (e.g., the low capillarity media 112 indirectly engages the bubble 116 via the high capillarity media 110). Based on capillary principles, the high and low capillarity media 110, 112 draw ink from the free ink chamber 108 until they are saturated.

The ink cartridge 102 in the illustrated example of FIG. 1 also includes a wick 118. In some examples, the wick 118 is also formed of a material having capillary properties that draws ink from the high capillarity media 110 until the wick 118 is fully saturated. In some examples, the wick 118 serves as the outlet for the ink in the ink cartridge 102 to be drawn into the PHA 104 as described above.

In the illustrated example, the PHA 104 includes a filter 120 at an inlet 122 of the PHA 104 and a die 124 at an outlet 126 of the PHA 104. In some examples, the inlet 122 and the outlet 126 are in fluid communication via one or more fluid paths or channels 128 defined by a manifold 130. As shown in the illustrated example, the fluid path(s) 128 guides ink from the ink cartridge 102 through the manifold 130 to an opening or plenum 132 above the die 124. In some examples, the plenum 132 is defined by a chiclet 134 disposed within a base 136 of the PHA 104. The plenum 132 is enclosed, in the illustrated example, by the die 124 affixed to the bottom of the chiclet 134. In some examples, the die 124 includes a plurality of nozzles 138 to provide fluid communication between an interior of the PHA 104 and an exterior of the PHA 104.

In the example of FIG. 1, the service station 106 includes a cap 142, a pump 140, and a controller 144. In FIG. 1, the example service station 106 is coupled to the outlet 126 of the PHA 104. More specifically, in the illustrated example, the pump 140 of the service station 106 is coupled to the cap 142, and the cap 142, in turn, mates with the die 124. In this manner, when the pump 140 is activated, the pump 140 generates a vacuum at the cap 142 resulting in depressurization of the interior of the PHA 104. In some examples as air is evacuated from within the PHA 104 out through the nozzles 138 of the die 124 based on the vacuum generated by the pump 140, the resulting reduced pressure within the PHA 104 will also suck or draw ink into and through the PHA 104. In some examples, the cap 142 is mated with die 124 while priming the PHA 104 and positioned away from the PHA 104 at other times (e.g., when the imaging system 100 is being used for printing). That is, in some examples, the PHA 104 and the service station 106 move relative to each another so that the service station 106 does not impede the PHA 104 when implementing a printing process. In the illustrated example, the service station 106 includes a controller 144 to control the pump 140. For example, the controller 144 controls the speed of the pump 140 to define the corresponding vacuum that will be generated at the cap 142 and applied to the die 124. Further, in some examples, the controller 144 controls the timing and duration of the operation of the pump 140.

Although the imaging system 100 of FIG. 1 shows a single ink cartridge 102 snapped into the PHA 104, in some examples, the PHA 104 is configured to hold multiple ink cartridges and/or the connections between the ink cartridge(s) and the PHA 104 are achieved in a different manner. In some such examples, the multiple ink cartridges include the same color ink (e.g., two black cartridges). In some other examples, the multiple ink cartridges include any combination of colored inks (e.g., one or more of any of a cyan ink cartridge, a magenta ink cartridge, a yellow ink cartridge, and/or a black ink cartridge). In some such examples, the pump 140 is coupled to each of the multiple ink cartridges to simultaneously draw ink from all of the ink cartridges. In other examples, the pump 140 has multiple channels to act on individual ink cartridges and or sets of cartridges at a single time (e.g., one channel for black ink and another channel for color ink(s)). Additionally or alternatively, in some examples, the imaging system 100 includes one or more additional pumps to be used for different ink cartridges and/or for backup, redundancy and/or reliability.

Figure 2:
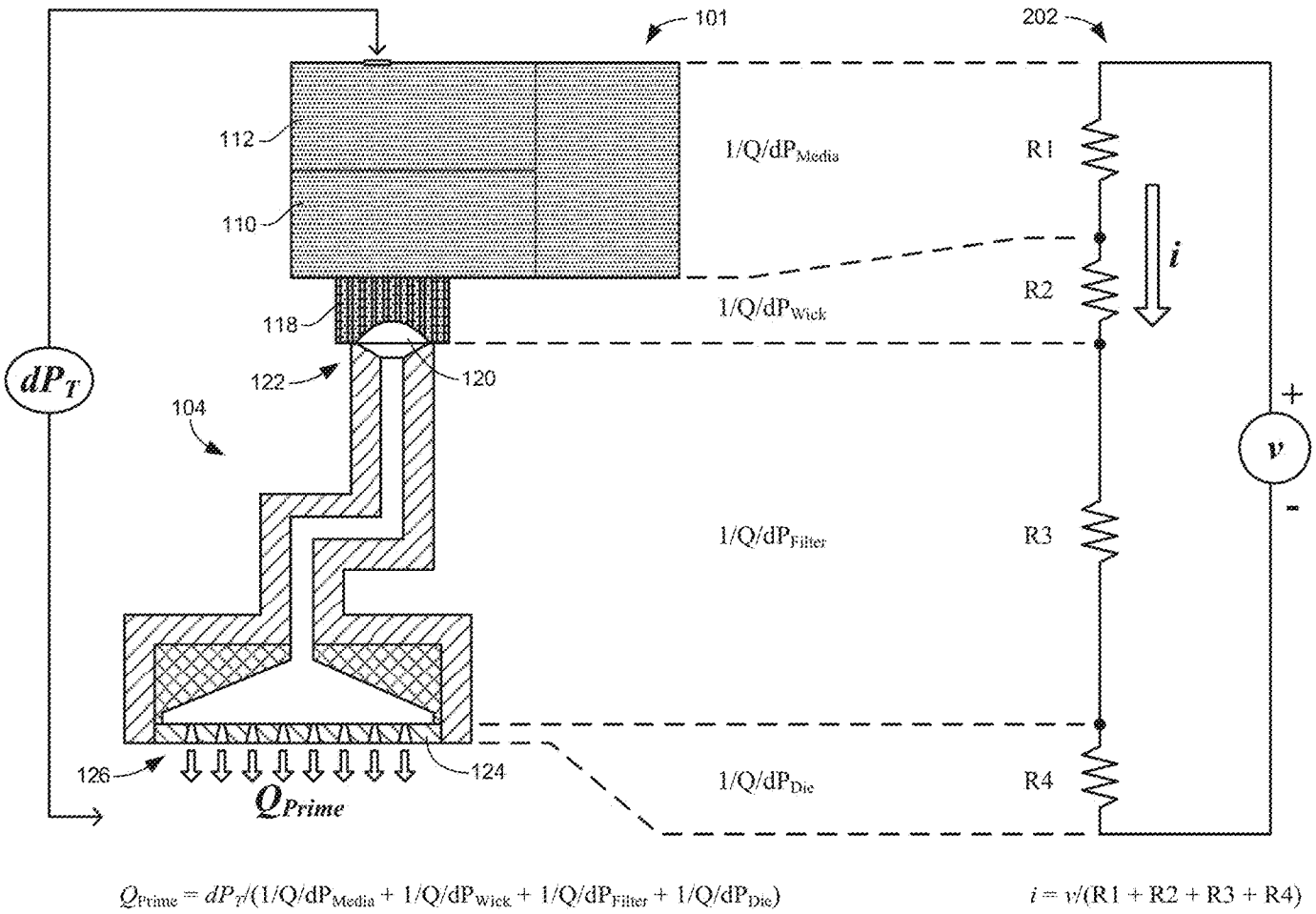
FIG. 2 is a schematic illustration of the example ink delivery system of FIG. 1 alongside an analogous electrical circuit representative of the pressures and flows within the example ink delivery system.

FIG. 2 is a schematic illustration of the example ink delivery system 101 of FIG. 1 alongside an analogous electrical circuit 202 to illustrate the pressure within the example ink delivery system 101. Pressures and flows through porous media (as in the ink delivery system 101) are governed by Darcy's Law, which can be expressed as follows:

$$Q/dP=kA/\mu L$$

Where Q/dP is the permeability of the component(s) (where Q is the flow rate and dP is the pressure difference across component(s)); k is the intrinsic permeability (a constant that depends solely on the properties of the porous component (e.g., porosity, tortuosity); A is the cross-sectional flow area; p is the viscosity of the fluid (e.g., ink) flowing through the component(s); and L is the length of the component(s).

The permeability (Q/dP) is the inverse of resistance to flow and can be characterized for each component by inducing a flow rate and measuring the pressure difference across the component. The flow across multiple components can be analogized to resistors in series in an electrical circuit as shown in FIG. 2. That is, the resistance to flow across the low and high capillarity media 110, 112 of the ink cartridge 102 ($1/Q/dP_{Media}$) is analogous to a first resistor (R1) in the example circuit 202; the resistance to flow across the wick 118 ($1/Q/dP_{Wick}$) is analogous to a second resistor (R2) in the example circuit 202; the resistance to flow through the filter 120 ($1/Q/dP_{Filter}$) is analogous to a third resistor (R3) in the example circuit 202 (as shown in the illustrated example, the resistance to flow through the channel or fluid path 128 (which primarily arises from friction and thus is relatively small) is included within the resistance to flow through the filter 120 for simplicity of explanation); and the resistance to flow through the die 124 ($1/Q/dP_{Die}$) is analogous to a fourth resistor (R4) in the example circuit 202. With a total pressure difference ($dP_T$) across the ink delivery system 101 the flow of ink during a prime ($Q_{Prime}$) through the ink delivery system 101 may be expressed as follows:

$$Q_{Prime}=dP_T(1/Q/dP_{media}+q/Q/dP_{Wick}+1/Q/dP_{Filter}+1/Q/dP_{Die})$$

The resistance to flow through the filter 120 (and associated fluid path 128) corresponding to the third resistor (R3) in the circuit 202 and the resistance to flow through the die 124 corresponding to the fourth resistor (R4) in the circuit 202 vary significantly depending on whether the PHA 104 is filled with ink or air (e.g., before or after the PHA 104 has been initially primed). For example, because the viscosity (μ) of air is so much lower than the viscosity of ink, the resistance to flow across the die ($1/Q/dP_{Die}$) and the resistance to flow across the filter (1/Q/dP are negligible when the PHA 104 is filled with air. That is, to analogize to the example circuit 202 of FIG. 2, the third and fourth resistors R3, R4 would be effectively absent (e.g., short circuited). As a result, the pressure along the corresponding length of the PHA 104 (e.g., between the inlet 122 and the outlet 126) would be substantially constant. Put another way, the pressure (vacuum) generated at the cap 142 by the pump 140 (FIG. 1) that acts on the outside of the die 124 would be the same pressure (vacuum) acting on the filter 120 mating with the wick 118. In contrast, when the PHA 104 is filled with ink, there will be a pressure drop or pressure difference across the filter 120, along the channel 128, and across the die 124 such that the pressure at the cap 142 will be significantly different than the pressure at the filter 120 (e.g., the pressure at the cap 142 will be much lower than at the filter 120). In some examples, the pressure difference across the die 124 reduces the vacuum within the PHA 104 (relative to the vacuum at the cap 142) approximately by a factor of four. However, in other examples, the ratio between the pressures on each side of the die 124 is different for different geometries of the die 124 and/or different fluid properties (e.g., viscosity) of the ink. In some examples, the bulk of the pressure difference between the pressure at the cap 142 and the pressure at the filter 120 is the result of the pressure drop across the die 124 because of the physical properties of the die 124 having the small nozzles 138 through which the ink and/or air is to pass.

The significant difference in pressure at the filter 120 (depending on whether there is air or ink in the PHA 104) impacts how effectively the pump 140 can prime the PHA 104 while running at a particular speed (to generate a particular vacuum). For example, once ink has impregnated (e.g., wetted out) the die 124, air will not be pulled through the nozzles 138 of the die 124 unless the pressure difference across the die 124 exceeds the bubble pressure of the die 124, which depends upon a relatively high level of vacuum generated at the cap 142. However, if a high level of vacuum is generated at the cap 142 when the nozzles 138 are not covered with ink, the high level of vacuum will act directly on the filter 120 (because there is almost no resistance across the die 124 or through the channel 128) to create a pressure difference across the filter 120 and/or the mating wick 118 that may exceed the bubble pressure of the filter 120 and/or the wick 118. As such, the vacuum may suck air through the filter 120 in addition to ink, thereby undermining the goal of removing air from the PHA 104 as air is instead drawn into the PHA 104.

As used herein, bubble pressure refers to the difference in pressure between opposite sides of a membrane-like component, which has been wetted out (impregnated with a fluid (e.g., ink)), above which air on the relatively high pressure side will pass through the component to the relatively low pressure side. Any pressure difference across the component below the bubble pressure will only draw the fluid (e.g., ink) through the component. Bubble pressure is a function of the physical properties of the corresponding component (e.g., porosity) and the fluids involved (e.g., ink and air). In the illustrated example, the die 124 with the nozzles 138, the filter 120, and the wick 118 are each membrane-like components that have corresponding bubble pressures. In some examples, the bubble pressure for the die 124 is greater than the bubble pressures for the filter 120 and/or the wick 118

In some such examples, to effectively remove air from a PHA 104 through the die 124, the vacuum at the cap 142 is sufficiently strong (e.g., the pressure sufficiently low) to produce a pressure difference across the die 124 (when wetted out) that exceeds the die bubble pressure. In some examples, such a pressure difference is achieved with a level of vacuum (generated at the cap 142) corresponding to a pressure ranging from about 100-150 inches of water below the ambient pressure (e.g., atmospheric pressure). At the same time, in such examples, to reduce (e.g., prevent) air being drawn into the PHA 104 via the filter 120, the vacuum acting on the filter 120 is maintained at a level small enough not to produce a pressure difference across the filter 120 that exceeds the bubble pressure of the filter 120. That is, the pressure difference across the filter 120 is kept below the filter bubble pressure. In some examples, remaining below such a pressure difference is achieved with a level of vacuum corresponding to a pressure that is less than 60 inches of water below the ambient pressure. However, the vacuum acting on the filter 120 relative to the vacuum generated at the cap 142 by the pump 140 varies significantly depending on whether the die 124 is wetted out. If the nozzles 138 are covered with ink (i.e., the die 124 is wetted out), the resulting pressure difference across the die 124 will reduce the vacuum generated at the cap 142 to a much smaller vacuum within the PHA 104 and acting on the filter 120. In contrast, if the die 124 is not wetted out, then the vacuum at the cap 142 will be transmitted directly to the filter 120 without any significant mitigation in its strength. Thus, the pump 140 driven at a single speed corresponding to a certain level of vacuum at the cap 142 cannot be both high enough to withdraw air from the outlet 126 of the PHA 104 (e.g., over 100 inches of water below ambient pressure in the example above) and low enough to not pull additional air into the PHA 104 from the inlet 122 (less than 60 inches of water below ambient pressure in the example above).

In some examples, depending on certain parameters involved (e.g., viscosities, pressures, bubble pressures, etc.) the filter bubble pressure is exceeded before the wick bubble pressure is exceeded. In other examples, the wick bubble pressure is exceeded before the filter bubble pressure. In such examples, the vacuum within the PHA 104 (acting on the filter 120) is kept below the point at which a corresponding pressure difference across the wick 118 reaches the bubble pressure of the wick 118. Further, in some such examples, exceeding the bubble pressure of the wick 118 leads to the filter bubble pressure being exceeded. For example, when a pressure difference across the wick 118 exceeds the wick bubble pressure, the wick 118 desaturates as air is drawn into the wick 118 choking off a portion of the wick 118. With part of the wick 118 choked off, the flow of ink through the ink delivery system 101 is reduced. The reduction in the flow of ink causes the pressure through the ink delivery system 101 to increase such that a constant vacuum from the pump 140 will create a greater pressure difference across the filter 120 leading to the bubble pressure of the filter 120 being exceeded, at which point air will be drawn into the PHA 104. As such, the vacuum generated by the pump 140 needs to be considered in light of the bubble pressures for each of the die 124, the filter 120, and the wick 118.

Figure 3:
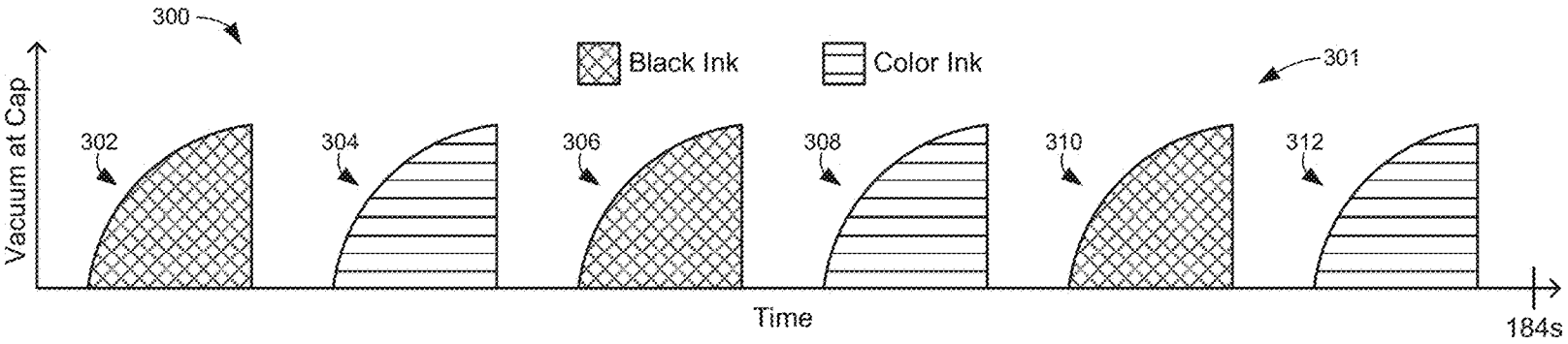
FIG. 3 (Prior Art)
FIG. 3 is a graph illustrating the level of vacuum applied to the example ink deliver system of FIG. 1 during a known priming process.

FIG. 3 is a graph 300 illustrating the vacuum generated at the cap 142 of the PHA 104 as the PHA 104 is initialized (e.g., primed for the first time) via a known priming process 301. The graph 300 is not shown to scale but is representative of the magnitude of vacuum at the cap 142 (e.g., the amount of pressure below atmospheric pressure) at a given point in time. In the illustrated example of FIG. 3, the priming process 301 includes a series of six separates primes including a first black prime 302, a first color prime 304, a second black prime 306, a second color prime 308, a third black prime 310, and a third color prime 312. Each of the primes 302, 304, 306, 308, 310, 312 are implemented similarly in that the pump 140 is initially turned on and runs at a constant rate through the duration of the prime before shutting off. In some known examples, the pump 140 operates at the same constant speed during each of the six primes 302, 304, 306, 308, 310, 312. In other examples, the fixed rate of the pump 140 varies between the primes 302, 304, 306, 308, 310, 312. For example, the black primes 302, 306, 310 are implemented at one speed while the color primes 304, 308, 312 are implemented at another speed. The constant speed of the pump 140 during each prime 302, 304, 306, 308, 310, 312 results in a pressure profile having a shape generally resembling a shark fin where the vacuum rapidly increasing at the beginning of each prime 302, 304, 306, 308, 310, 312 but slows towards the end of each prime as the level of vacuum associated with the speed of the pump 140 is reached (e.g., the steady state level of vacuum generated by the pump 140 operating at its current speed). Once the pump 140 shuts off at the end of each prime 302, 304, 306, 308, 310, 312, the pressure at the cap 142 returns to normal (e.g., atmospheric pressure).

In the illustrated example, there are three black primes 302, 306, 310 and three color primes 304, 308, 312, because black ink is frequently handled separately from color ink due to the somewhat different fluid properties between black and color ink. In some examples, the three color primes 304, 308, 312 involve priming multiple ink cartridges (e.g., ink cartridges corresponding to cyan, magenta, and yellow ink). In some examples, the pump 140 is implemented for all six of the primes 302, 304, 306, 308, 310, 312. In some such examples, the pump 140 has a first channel devoted to the black ink and a second channel devoted to the color ink.

In the past, as shown in the known priming process 301 of FIG. 3, the pump 140 primes the PHA 104 with the black and color ink three times each because a single prime is insufficient. In particular, during the initial prime (e.g., the first black prime 302 and the first color prime 304), while some ink is pulled into the PHA 104, air is also pulled into the PHA 104 because the vacuum generated by the pump 140 creates a pressure difference across the filter 120 (and/or the wick 118) that exceeds the bubble pressure of the filter 120 (and/or the wick 118). The high pressure difference results from the high level of vacuum created at the cap 142 being transmitted into the PHA 104 because there is no ink in the PHA 104 initially to create a pressure difference at the die 124 to reduce the vacuum within the PHA 104 that acts directly on the filter 120.

With some ink drawn into the PHA 104 during the initial primes (e.g., the first black prime 302 and the first color prime 304), the ink creates a pressure difference across the die 124 such that during the second prime for each of the black and color ink (e.g., the second black prime 306 and the second color prime 308) the pressure within the PHA 104 (acting on the filter 120) is higher than the pressure at the cap 142. That is, the vacuum within the PHA 104 acting on the filter 120 is lower than the vacuum at the cap 142. As a result, the vacuum within the PHA 104 is insufficient to create a pressure difference across the filter 120 (and/or wick 118) that exceeds the bubble pressure of the filter 120 (and/or wick 118) such that air is not drawn through the filter 120. However, in some instances, the second set of primes (e.g., the second black prime 306 and the second color prime 308) are still insufficient to evacuate all air from the PHA 104 such that a third set of primes (e.g., the third black prime 306 and the third color prime 308) are implemented to fully initialize or prime the PHA 104.

In some known examples, as shown in FIG. 3, the six primes 302, 304, 306, 308, 310, 312 alternate between black ink and color ink. Alternating between black and color ink provides additional time between each prime 302, 304, 306, 308, 310, 312 to allow the ink and air in the corresponding ink cartridge(s) to settle before the next prime 302, 304, 306, 308, 310, 312 is implemented.

In some examples, each of the known primes 302, 304, 306, 308, 310, 312 are relatively short in duration lasting only a few seconds. For instance, in one known example, the first color prime 304 takes approximately 2.3 seconds, the second color prime 308 takes approximately 1.2 seconds, and the third color prime 312 takes approximately 1.5 seconds. While each individual prime 302, 304, 306, 308, 310, 312 is relatively brief, the time period between each of the primes 302, 304, 306, 308, 310, 312 is much longer. That is, while the graph 300 is not shown to scale, the bulk of the time consumed during the priming process 301 is the mechanical movement of parts in the imaging system 100 before and/or after each of the primes 302, 304, 306, 308, 310, 312. For example, each prime 302, 304, 306, 308, 310, 312 involves the movement of ink that can be messy. Accordingly, after each prime 302, 304, 306, 308, 310, 312, the imaging system 100 goes through a cleaning process to wipe off and dispose of excess ink that was pulled through the PHA 104 during the preceding prime. Because the known priming process 301 involves six separate primes 302, 304, 306, 308, 310, 312, the example priming process 301 also includes six such cleaning processes that result in a relatively long priming process 301. In one known example, as illustrated in FIG. 3, the priming process 301 takes over three minutes (e.g., 184 seconds) from beginning to end. Such an extended period of time can be frustrating to an end user that desires to quickly set up and use a new printer or other imaging device. Furthermore, the mechanical movements involved in the priming process 301 can be noisy and annoying to an end user, which is exacerbated in that the movements are repeated six times over a long period. Another disadvantage of the known approach to initializing a new PHA illustrated in FIG. 3 is that the six separate primes 302, 304, 306, 308, 310, 312 use up considerable ink that cannot then be used for printing.

Figure 4:
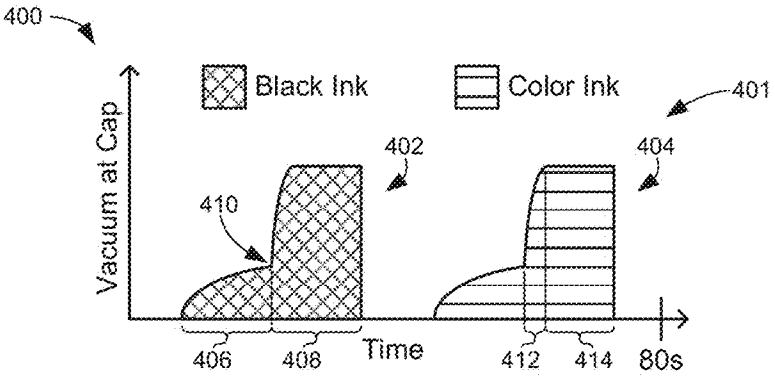
FIG. 4 is a graph illustrating the level of vacuum applied to the example ink deliver system of FIG. 1 during an example priming process implemented in accordance with the teachings disclosed herein.

FIG. 4 is a graph 400 illustrating the vacuum generated at the cap 142 of the PHA 104 being initialized (e.g., primed for the first time) via an example priming process 401 implemented in accordance with the teachings disclosed herein. The graph 400 is not shown to scale but is representative of the magnitude of vacuum at the cap 142 (e.g., the amount of pressure below atmospheric pressure) at a given point in time. In contrast to the known priming process 301 of FIG. 3 that has six primes 302, 304, 306, 308, 310, 312 including three black primes and three color primes, the example priming process 401 of FIG. 4 has only one black prime 402, and one color prime 404. As a result, the example priming process 401 involves only two cleaning processes, thereby significantly shortening the total period of the example priming process 401 when compared with the known priming process 301 of FIG. 3. In some examples, the total duration of the example priming process 401 is less than a minute and a half (e.g., 80 seconds). As such, an end user does not have to wait as nearly as long for a printer or other imaging device to initialize before the printer can be used as was required in prior art systems. Further, the reduced amount of time and the corresponding reduced amount of mechanical movements reduces the level of annoyance end users experience from the noise created by the mechanical movements. Additionally, because fewer primes are involved in the example priming process 401 of FIG. 4, the overall priming process wastes less ink than in the known approach illustrated in FIG. 3.

The example priming process 401 is possible via a single prime 402, 404 for each of black ink and color ink because of the unique pressure profile generated by the pump 140 operating at different speeds during different periods of each prime 402, 404. In the illustrated example, the profile of each of the primes 402, 404 generally resembles a boot with a first portion 406 corresponding to a toe portion of the boot and a second portion 408 corresponding to a leg portion of the boot. As shown in the illustrated example, the first and second portions 406, 408 meet at an inflection point 410. In some examples, the second portion 408 of the example primes 402, 404 includes a first segment 412 characterized by a rapid increase in the level of vacuum at the cap 142 generated by the pump 140 followed by a second segment 414 where the vacuum at the cap 142 is maintained at a substantially constant pressure.

In some examples, the pressure profile of each of the primes 402, 404 is accomplished by operating the pump 140 at a relatively slow and substantially constant speed during the first portion 406, increasing the pump speed to a relatively high and substantially constant speed during the first segment 412 of the second portion 408, and slightly lowering the speed of the pump 140 during the second segment 414 of the second portion 408. In some examples, the second portion 408 immediately follows the first portion 402. That is, in some examples, the pump 140 runs through the entire prime 402, 404 without stopping. In some examples, the pressure profile of the first portion 406 of the primes 402, 404 is characterized by a rapidly increasing vacuum that slows down as the vacuum increases to a steady state similar to the shark fin shape of the primes 302, 304, 306, 308, 310, 312 described above in connection with FIG. 3. However, the speed of the pump 140 during the first portion 406 of the example primes 402, 404 is much lower than during the primes 302, 304, 306, 308, 310, 312 of FIG. 3 such that the peak vacuum (e.g., the steady state vacuum generated by the pump 140 at its current operating speed) at the end of the first portion of the primes 402, 404 (e.g., at the inflection point 410) is substantially less than the peak vacuum generated in FIG. 3 (e.g., at the end of each prime 302, 304, 306, 308, 310, 312).

More particularly, in some examples, the speed of the pump 140 during the first portion 406 is set to correspond to a level of vacuum that will not produce a pressure difference across the filter 120 (and/or the wick 118) that exceeds the bubble pressure of the filter 120 (and/or the wick 118). That is, the vacuum at the inflection point 410 in the profile of the primes 402, 404 of the illustrated example of FIG. 4 is configured (based on a defined speed of the pump 140 during the first portion 406) to be below the level at which air will be pulled through the filter 120. In this manner, when the vacuum generated at the cap 142 is transmitted from the outlet 126 of the PHA 104 to the inlet 122 (because there is no ink in the PHA 104), the vacuum will be insufficient to draw in air through the filter 120. However, in some examples, the relatively slight vacuum generated by the pump 140 is sufficient to pull ink through the filter 120 and into the PHA 104 towards the die 124. In some examples, the duration of the first portion 406 of each of the primes 402, 404 corresponds to a period of time sufficient to pull enough ink into the PHA 104 and down to the die 124 to cover the nozzles 138 of the die 124. In this manner, a pressure difference across the die 124 can be generated to allow for a stronger (higher) vacuum at the cap 142 (e.g., a lower pressure) without the full vacuum being transmitted through the PHA 104 to act on the filter 120.

While the first portion 406 of the example primes 402, 404 results in the evacuation of some of the air within the PHA 104 (as the pressure is initially reduced), once the die 124 is impregnated with ink, air will no longer be drawn out of the PHA 104 because the relatively slight vacuum generated by the pump 140 during the first portion 406 is insufficient to produce a pressure difference across the die 124 that exceeds the die bubble pressure (i.e., the point at which air will pass through the nozzles 138 of the die 124).

In the illustrated example, once the period of time corresponding to the first portion 406 of the primes 402, 404 has elapsed, rather than the pump 140 deactivating as in FIG. 3, the second portion 408 of the example prime 402, 404 begins. In some examples, the speed of the pump 140 is significantly increased to a relatively high speed associated with a much higher peak vacuum (e.g., a much lower pressure) during the first segment of the second portion of the prime 402, 404 to quickly ramp up the vacuum to a level sufficient to draw air from within the PHA 104 out through the die 124. That is, the pump speed is run at a high rate to quickly lower the pressure enough to produce a pressure difference across the die 124 (made possible by the ink drawn down to the die 124 during the first portion 406) that exceeds the bubble pressure of the die 124. With the higher vacuum achieved, two-phase flow of both air and ink will occur through the die 124 to begin evacuating the remaining air within the PHA 104. In some examples, once the desired level of vacuum is achieved (e.g., corresponding to a pressure difference above the die bubble pressure), the speed of the pump 140 is slightly reduced during the second segment 414 of the second portion 408 of the prime 402, 404 to substantially maintain the vacuum at the desired level until the pump 124 shuts off at the end of the prime 402, 404. In some examples, the duration of the second portion 408 of the example prime 402, 404 corresponds to a period of time sufficient to allow air located at any point within the PHA 104 to travel the length of the channel 128 and be expelled out through the die 124. In this manner, most (e.g., all or substantially all) air within the PHA 104 is evacuated and replaced with ink.

In some examples, the initially higher speed of the pump 140 during the first segment 412 with the slightly reduced speed during the second segment 414 enable the pump 140 to reach the bubble pressure of the die 124 faster to reduce the time it takes to fully prime the PHA 104 (e.g., to fully evacuate air from the PHA 104). However, in other examples, the speed of the pump 140 is maintained at a substantially constant speed throughout the entire second portion 408 of the example primes 402, 404. Further, in other examples, the speed or speeds of the pump 140 while implementing the example primes 402, 404 may vary in any other suitable manner. Furthermore, while the foregoing description applies generally to both of the primes 402, 404, in some examples, the speed(s) of the pump 140 differ between the black ink prime 402 and the color ink prime 404 because the fluid properties of the black ink and the color ink are different such that the bubble pressures of the components being primed with each of the black ink and color ink are also different. Additionally, in some examples, the prime 402, 404 illustrated in FIG. 4 is implemented only with respect to the color ink while a different pressure profile or priming process is implemented with the color ink. In other examples, the prime 402, 404 shown in FIG. 4 is implemented only with respect to the black ink.

As described above in connection with the illustrated example of FIG. 4, unwanted air drawn into the PHA 104 through the inlet 122 is reduced (e.g., avoided) because the relatively low vacuum at the cap 142 during the first portion 406 is insufficient to draw in the air and the much higher vacuum at the cap 142 during the second portion 408 does not directly act on the filter 120 because of the pressure difference across the die 124 created by the ink covering the nozzles 138. Thus, in some examples, the focus of the first portion 406 of the example primes 402, 404 is to draw ink into the PHA 104 and down to the die 124, whereas the focus of the second portion 408 is to evacuated the remaining air within the PHA 104.

In some examples, the duration of the portions of the example primes 402, 404 are determined based on empirical testing and/or theoretical calculations performed by the manufacturer of the PHA 104 to determine how long it takes for ink to reach the die 124 (e.g., the first portion 406) and how long it takes a bubble or pocket of air at the inlet 122 of the PHA 104 to be carried all the way through the fluid path 128 PHA 104 and drawn out the nozzles 138 of the die 124 (e.g., the second portion 408). Specifically, in some examples, the entire duration of each prime 402, 404 is less than ten seconds (e.g., approximately 6 seconds). In some examples, the duration of the first portion 406 is approximately 2.8 seconds, the duration of the first segment 412 of the second portion is approximately 0.9 seconds, and the duration of the second segment 414 of the second portion 408 is approximately 2.5 seconds.

Figure 5:
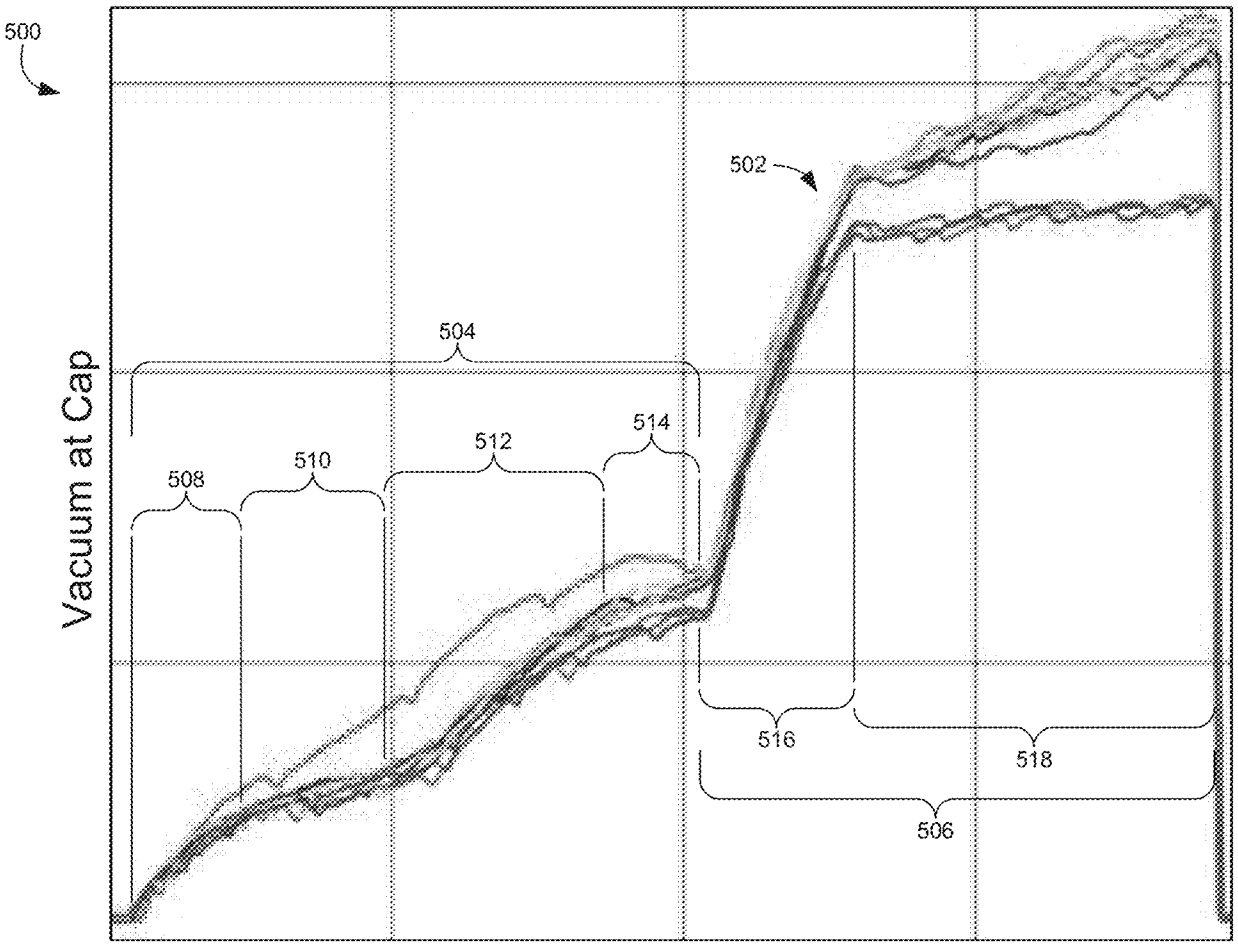
FIG. 5 is a graph illustrating example empirically measured pressure profiles associated with the example priming process of FIG. 4.

FIG. 5 is a graph 500 illustrating example empirically measured pressure profiles 502 associated with the example ink delivery system 101 of FIG. 1 as it is being primed in accordance with the teachings disclosed herein. The graph 500 is representative of the magnitude or level of vacuum at the cap 142 (e.g., the amount of pressure below atmospheric pressure) at a given point in time. As shown in FIG. 5, the measured pressure profiles 502 are similar to the pressure profile of the example primes 402, 404 of FIG. 4 with a first portion 504 and a second portion 506 similar to the first portion 406 and the second portion 408 described above. More particularly, the first portion 504 of the example pressure profiles 502 is characterized by four different segments 508, 510, 512, 514 identified by inflection points within the measured pressure profile 502. Though the pump 140 is driven at a substantially constant rate throughout the first portion 504, the particular pressure profile and the corresponding rates of change in the vacuum over time are a function of what is physically occurring inside the ink delivery system 101.

For example, during the first segment 508, as the pump 140 first begins to operate, the air within the PHA 104 (e.g., within the plenum 132 and channel 128) begins to evacuate, thereby increasing the vacuum (lowering the pressure) within the PHA 104, but before the vacuum is sufficient to begin drawing in ink from the ink cartridge 102. Although the graph 500 shows the level of vacuum at the cap 142, the vacuum within the PHA 104 during the first portion 504 is substantially the same because there is no ink in the PHA 104 yet to create a pressure differential between the cap 142 at the outlet 126 and the filter 120 and the inlet 122. The second segment 510 of the first portion 504 of the measured pressure profiles 502 is characterized by ink from the ink cartridge 102 being drawn or sucked from the wick 118 via the filter 120 into the PHA 104 and down through the channel 128 towards the plenum 132 and the die 124. That is, the inflection point at the transition between the first and second segments 508, 510 corresponds to the level of vacuum sufficient to suck ink through the wick 118. The next inflection point, at the transition of the second segment 510 and the third segment 512 is indicative of the ink reaching the die 124 to begin covering and/or entering the nozzles 138. Thus, the third segment 512 corresponds to the period in which the die 124 is wetted out by the ink. Finally, the fourth segment 514 is characterized by ink being drawn through or pulled out of the nozzles 138 and into the cap 142 indicative of the die 124 being fully impregnated or wetted out with ink.

As shown in FIG. 5, the second portion 506 of the example pressure profiles 502 includes a first segment 516 (e.g., corresponding to the first segment 412 of the second portion 408 of FIG. 4) and a second segment 518 (e.g., corresponding to the second segment 414 of the second portion 408 of FIG. 4). The first segment 516 is characterized by a steep rise in vacuum based on the pump 140 running at a high speed to quickly increase the vacuum to a level sufficient to draw both ink and air through the now wetted die. That is, the vacuum generated by the pump 140 during the first segment 516 of the second portion 506 of the example pressure profiles 502 reduce the pressure enough to generate a pressure difference across the die 124 (made possible by the ink now in the nozzles 138) that exceeds the bubble pressure of the die 124. With the vacuum increased to a level where two-phase flow occurs within the channel 128 of the PHA 104 and through the die 124 of the PHA 104, the vacuum does not need to be increased any further. Accordingly, as shown in the illustrated graph 500 of FIG. 5, the vacuum generated by the pump 140 is maintained at a substantially constant level during the second segment 518. In some examples, the substantially constant level of vacuum of the second segment 518 is accomplished by slightly reducing the speed of the pump 140 from its speed during the first segment 516. The substantially constant vacuum of the second segment 518 is maintained for a duration sufficient to allow most (e.g., all) air to be carried out and/or evacuated from inside the PHA 104. In such examples, at the end of the second segment of the second portion 506 of the example pressure profiles 502 of FIG. 5, the PHA 104 is completely primed with most (e.g., all or substantially all) air removed and replaced with ink.

Figure 6:
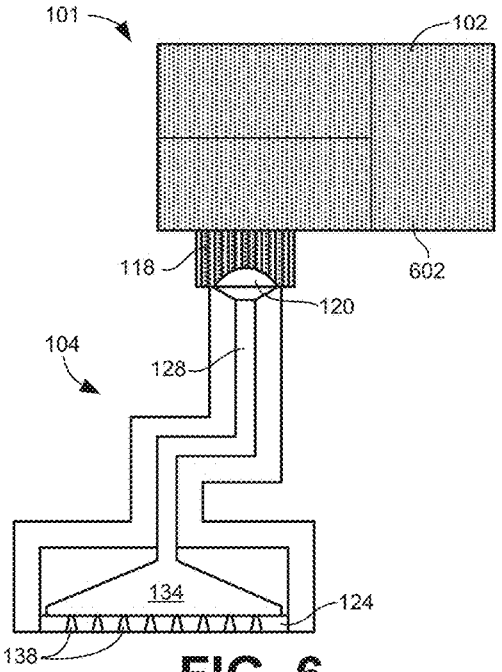
FIGS. 6-9 illustrate the example ink delivery system of FIG. 1 at various stages during the example priming process of FIGS. 4 and/or 5.

FIGS. 6-9 illustrate the example ink delivery system 101 of FIG. 1 at various stages during a prime (e.g., one of the primes 402, 404) implemented in accordance with the teachings disclosed herein. In particular, FIG. 6 illustrates the example ink delivery system 101 before the prime has started. As shown in the illustrated example, the ink cartridge 102, including the wick 118, is filled or saturated with ink 602 (represented via shading). However, in the illustrated example, the PHA 104, including the filter 120, the fluid path 128, the plenum 132, and the nozzles 138 of the die 124 are completely dry.

Figure 7:
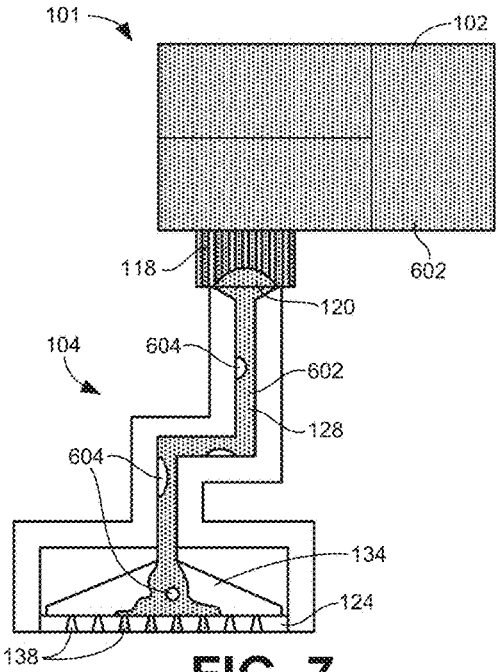

FIG. 7 illustrates the example ink delivery system 101 during the first portion 406 of the example primes 402, 404 of FIG. 4 or the first portion 504 of FIG. 5. More particularly, the example ink delivery system 101 shown in FIG. 7 corresponds to the third segment 512 of FIG. 5. As shown in the illustrated example, the slight vacuum created by the pump 140 has drawn some ink 602 into the fluid path 128 and plenum 132 of the PHA 104. Further, the ink 602, in the illustrated example, has begun to fill the nozzles 138 of the die 124. However, as illustrated in FIG. 7, some of the nozzles 138 remain open such that the vacuum generated outside the PHA 104 at the die 124 is still transmitted into the PHA 104. As a result, the pump 140 continues to operate a relatively slow speed to keep the vacuum generated at the cap 142 low enough so that a pressure difference across the filter 120 and/or the wick 118 does not exceed the corresponding bubble pressure. As shown in the illustrated example of FIG. 7, there are bubbles 604 within the ink 602 along the fluid path 128 because the vacuum acting on the PHA 104 is not strong enough to generate sufficient flow of the ink to detach the bubbles 604 from the walls of the PHA 104 and/or to draw the air from the bubbles 604 (or air in the plenum 132) out through the nozzles 138.

Figure 8:
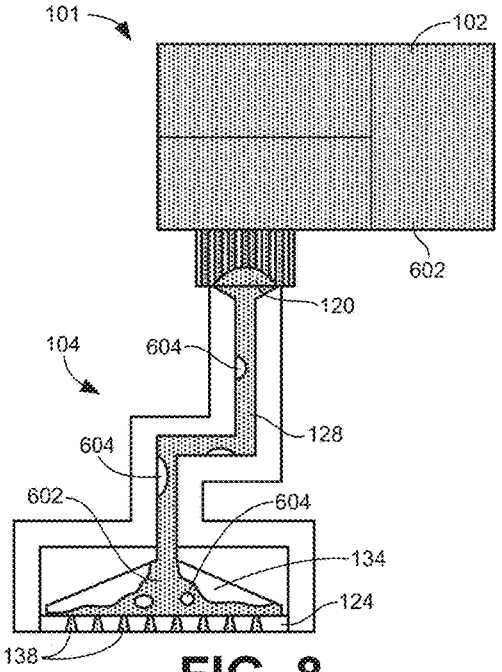

FIG. 8 illustrates the example ink delivery system 101 at the inflection point 410 of the example primes 402, 404 of FIG. 4. As shown in the illustrated example, as compared to FIG. 7, more of the ink 602 has been drawn from the ink cartridge 102 into the PHA 104 and down into the plenum 132 to cover the nozzles 138. As a result, in the illustrated example, the ink 602 creates a pressure drop across the die 124 such that a vacuum generated by the pump 140 acting on the die 124 will be much greater than the vacuum within the PHA 104. As shown in illustrated example of FIG. 8, the bubbles 604 are still within the ink 602 along the fluid path 128 because the vacuum at the die 124 has not yet increased sufficiently to dislodge the bubbles 604 and draw the air out through the nozzles 138.

Figure 9:
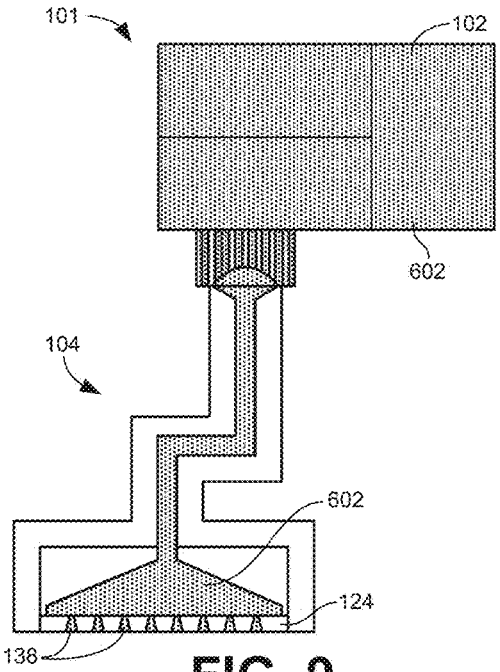

FIG. 9 illustrates the example ink delivery system 101 at the end and/or after the second portion 408 of the example primes 402, 404 of FIG. 4. As shown in the illustrated example, the PHA 104 has been filled with the ink 602 while most (e.g., all or substantially all) air, including the bubbles 604, has been evacuated out. The air in the illustrated example has been evacuated because the increased vacuum during the second portion 408 of the primes 402, 404 is strong enough to generate a flow of the ink 602 sufficient to dislodge the bubbles 604 and strong enough to pull the air through the nozzles 138 (e.g., by reaching a pressure sufficiently below the pressure within the PHA 104 such that the difference exceeds the bubble pressure of the die 124).

Figure 10:
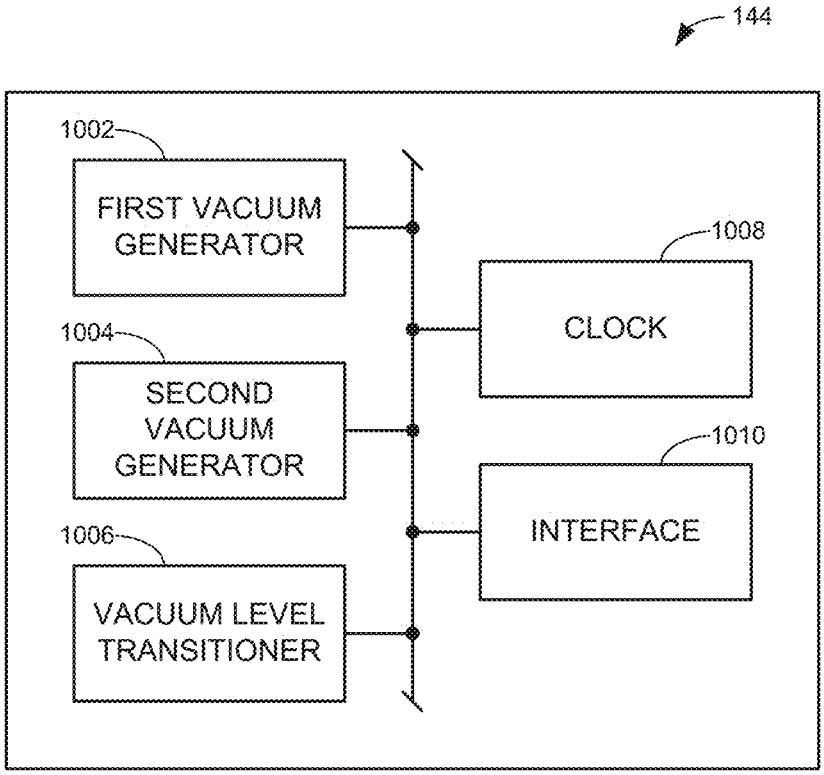
FIG. 10 a block diagram of an example implementation of the example controller of FIG. 1.

FIG. 10 illustrates an example implementation of the controller 144 of FIG. 1. In the illustrated example, the controller 144 includes an example first vacuum generator 1002, an example second vacuum generator 1004, an example vacuum level transitioner 1006, an example clock 1008, and an example interface 1010.

In some examples, the controller 144 of FIG. 10 is provided with the example first vacuum generator 1002 to drive the pump 140 at a first speed associated with a first partial vacuum that is relatively small. In some examples, the first vacuum generator 1002 drives the pump 140 during a first portion of a prime of the PHA 104 (e.g., the first portion 406 of the example primes 402, 404). Thus, in some examples, the first partial vacuum associated with the first vacuum generator 1002 corresponds to the peak vacuum achieved during the first portion 406 (e.g., the level of vacuum reached at the inflection point 410 of the example primes 402, 404). In some examples, the speed of the pump 140 as driven by the first vacuum generator 1002 is set such that the corresponding partial vacuum is insufficient to generate a pressure difference across the filter 120 and/or the wick 118 that exceeds the bubble pressure corresponding to the filter 120 and/or wick 118. As such a level of vacuum (e.g., the first partial vacuum) is based on the physical properties of the filter 120 and/or wick 118 as well as the ink used in the imaging system 100. In some examples, the particular speed of the pump 140 to achieve the first partial vacuum varies from one PHA to another and/or varies depending on the type of ink in the ink cartridge being used to prime the PHA (e.g., black ink versus color ink). In some examples, the speed is determined and/or defined by a manufacturer of the imaging system 100 based on empirical tests of the pump 140 priming the PHA 104. In some examples, the duration of the first vacuum generator 1002 running the pump 140 at the first speed is set to a fixed period of time sufficient to allow ink to be drawn in from the ink cartridge 102 and be pulled down through the PHA 104 to wet out the die 124. In some examples, the fixed period is determined and/or defined by a manufacturer of the imaging system 100 based on empirical testing. In some examples, the duration is controlled by the example clock 1008.

In the illustrated example of FIG. 10, the controller 144 is provided with the example second vacuum generator 1004 to drive the pump 140 at a second speed associated with a second partial vacuum that is much higher than the first partial vacuum (e.g., associated with a much lower pressure). That is, the second speed of the pump 140 driven by the second vacuum generator 1004 is much greater than the first speed of the pump 140 when driven by the first vacuum generator 1002. In some examples, the second vacuum generator 1004 drives the pump 140 during a second portion of a prime of the PHA 104 (e.g., the second portion 408 of the example primes 402, 404). More particularly, in some examples, the second vacuum generator 1004 drives the pump 140 during the second segment 414 of the second portion 408 of the example primes 402, 404. Thus, in some examples, the second partial vacuum associated with the second vacuum generator 1004 corresponds to the substantially constant vacuum maintained during the second segment 414. In some examples, the speed of the pump 140 as driven by the second vacuum generator 1004 is set such that the corresponding second partial vacuum is sufficient to generate a pressure difference across the die 124 of the PHA 104 that exceeds the bubble pressure of the die 124. As the die bubble pressure is a function of the physical properties of the die 124 and the ink used in the imaging system 100, in some examples, the particular speed of the pump 140 and the corresponding vacuum generated by the second vacuum generator 1004 varies from one PHA to another and/or varies depending on the type of ink in the ink cartridge being used to prime the PHA (e.g., black ink versus color ink). In some examples, the speed is determined and/or defined by a manufacturer of the imaging device 10 based on empirical tests of the pump 140 priming the PHA 104. In some examples, the duration of the second vacuum generator 1004 running the pump 140 at the second speed is set to a fixed period of time sufficient to allow most (e.g., all or substantially all) air within the PHA 104 to be drawn out through the die 124. In some examples, the fixed period is determined and/or defined by a manufacturer of the imaging system 100 based on empirical testing. In some examples, the duration is controlled by the example clock 1008.

In some examples, as shown in FIG. 10, the controller 144 is provided with the example vacuum level transitioner 1006 to drive the pump 140 at a third speed to increase the vacuum generated by the pump 140 and transition from the first partial vacuum to the second partial vacuum in a relatively short period of time. In some examples, the vacuum level transitioner 1006 drives the pump 140 during the second portion 408 of the example primes 402, 404. More particularly, in some examples, the vacuum level transitioner 1006 drives the pump 140 during the first segment 412 of the second portion 408 of the example primes 402, 404. In some examples, the third speed of the pump 140 as driven by the vacuum level transitioner 1006 is greater than the second speed of the pump 140 driven by the second vacuum generator 1004. In this manner, the vacuum generated by the pump 140 is ramped up relatively quickly until it reaches the second partial vacuum whereupon, in some examples, the second vacuum generator 1004 takes over control of the pump 140 to maintain the second partial vacuum. In some examples, the third speed of the pump is defined based on the capacity of the pump 140. In some examples, the second speed is slightly slower than the third speed relative to the first speed of the pump 140 that is much slower than either the second or third speeds. In some examples, the duration of the vacuum level transitioner 1006 running the pump 140 at the third speed is set to a fixed period of time sufficient to reduce the pressure at the cap 142 from the first partial vacuum (achieved by the first vacuum generator 1002) to the second partial vacuum (maintained by the second vacuum generator 1004). In some examples, the fixed period is determined and/or defined by a manufacturer of the imaging system 100 based on empirical testing. In some examples, the duration is controlled by the example clock 1008.

The example interface 1010 is provided in the controller 144 of the illustrated example to enable communication between the first and second vacuum generators 1002, 1004, the vacuum level transitioner 1006, and the pump 140. Additionally or alternatively, in some examples, the interface 1010 enables communications between the controller 144 and other components associated with the imaging system 100 of FIG. 1, such as, for example, the components used to clean the PHA 104 after it is primed.

While an example manner of implementing the controller 144 of FIG. 1 is illustrated in FIG. 10, one or more of the elements, processes and/or devices illustrated in FIG. 10 may be combined, divided, re-arranged, omitted, eliminated and/or implemented in any other way. Further, the example first vacuum generator 1002, the example second vacuum generator 1004, the example vacuum level transitioner 1006, the example clock 1008, the example interface 1010 and/or, more generally, the example controller 144 of FIG. 1 may be implemented by hardware, software, firmware and/or any combination of hardware, software and/or firmware. Thus, for example, any of the example first vacuum generator 1002, the example second vacuum generator 1004, the example vacuum level transitioner 1006, the example clock 1008, the example interface 1010 and/or, more generally, the example controller 144 could be implemented by one or more analog or digital circuit(s), logic circuits, programmable processor(s), application specific integrated circuit(s) (ASIC(s)), programmable logic device(s) (PLD(s)) and/or field programmable logic device(s) (FPLD(s)). When reading any of the apparatus or system claims of this patent to cover a purely software and/or firmware implementation, at least one of the example first vacuum generator 1002, the example second vacuum generator 1004, the example vacuum level transitioner 1006, the example clock 1008, and/or the example interface 1010 is/are hereby expressly defined to include a tangible computer readable storage device or storage disk such as a memory, a digital versatile disk (DVD), a compact disk (CD), a Blu-ray disk, etc. storing the software and/or firmware. Further still, the example controller 144 of FIG. 1 may include one or more elements, processes and/or devices in addition to, or instead of, those illustrated in FIG. 10, and/or may include more than one of any or all of the illustrated elements, processes and devices.

Flowcharts representative of example machine readable instructions for implementing the controller 144 of FIGS. 1 and/or 10 is shown in FIGS. 11-14. In this example, the machine readable instructions comprise a program for execution by a processor such as the processor 1612 shown in the example processor platform 1600 discussed below in connection with FIG. 16. The program may be embodied in software stored on a tangible computer readable storage medium such as a CD-ROM, a floppy disk, a hard drive, a digital versatile disk (DVD), a Blu-ray disk, or a memory associated with the processor 1612, but the entire program and/or parts thereof could alternatively be executed by a device other than the processor 1612 and/or embodied in firmware or dedicated hardware. Further, although the example program is described with reference to the flowchart illustrated in FIGS. 11-14, many other methods of implementing the example controller 144 may alternatively be used. For example, the order of execution of the blocks may be changed, and/or some of the blocks described may be changed, eliminated, or combined.

As mentioned above, the example processes of FIGS. 11-14 may be implemented using coded instructions (e.g., computer and/or machine readable instructions) stored on a tangible computer readable storage medium such as a hard disk drive, a flash memory, a read-only memory (ROM), a compact disk (CD), a digital versatile disk (DVD), a cache, a random-access memory (RAM) and/or any other storage device or storage disk in which information is stored for any duration (e.g., for extended time periods, permanently, for brief instances, for temporarily buffering, and/or for caching of the information). As used herein, the term tangible computer readable storage medium is expressly defined to include any type of computer readable storage device and/or storage disk and to exclude propagating signals. As used herein, "tangible computer readable storage medium" and "tangible machine readable storage medium" are used interchangeably. Additionally or alternatively, the example processes of FIGS. 11-14 may be implemented using coded instructions (e.g., computer and/or machine readable instructions) stored on a non-transitory computer and/or machine readable medium such as a hard disk drive, a flash memory, a read-only memory, a compact disk, a digital versatile disk, a cache, a random-access memory and/or any other storage device or storage disk in which information is stored for any duration (e.g., for extended time periods, permanently, for brief instances, for temporarily buffering, and/or for caching of the information). As used herein, the term non-transitory computer readable medium is expressly defined to include any type of computer readable device or disk and to exclude propagating signals. As used herein, when the phrase "at least" is used as the transition term in a preamble of a claim, it is open-ended in the same manner as the term "comprising" is open ended.

Figure 11:
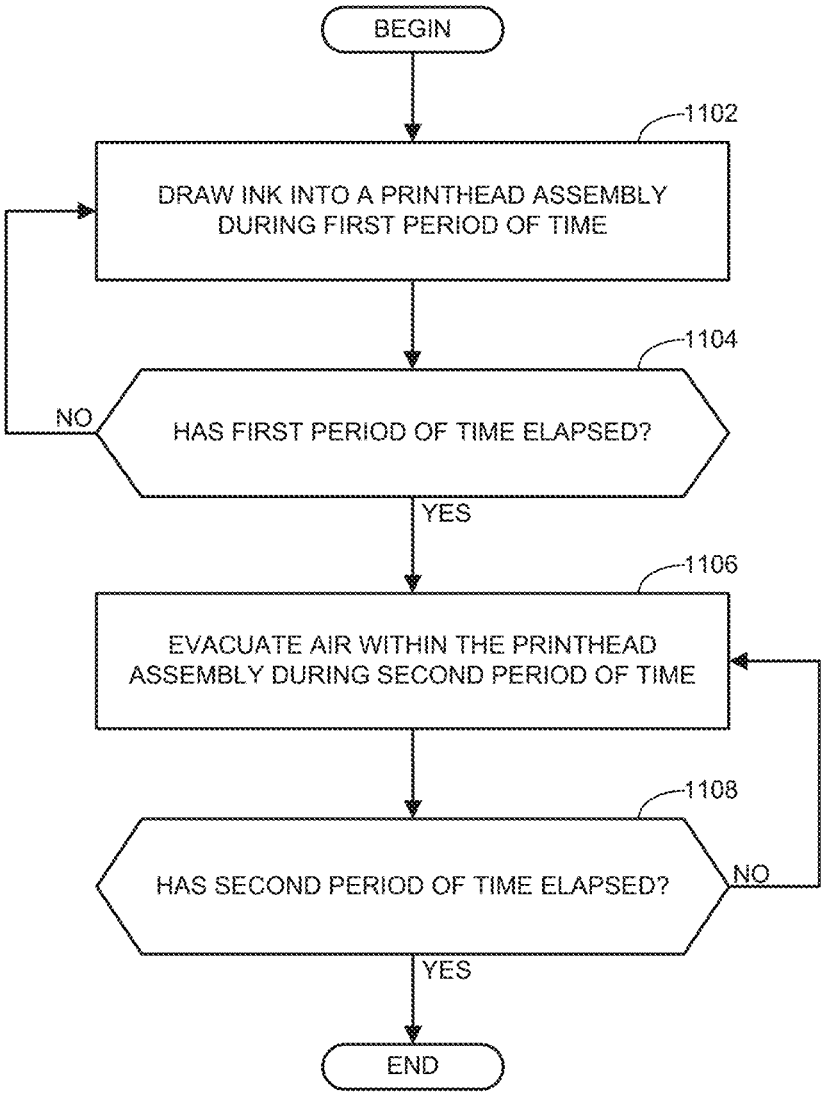
FIGS. 11-14 are flowcharts representative of example machine readable instructions that may be executed to implement the controller of FIGS. 1 and/or 10.

Turning in detail to FIG. 11, the example program begins at block 1102 where the example first vacuum generator 1002 draws ink into a printhead assembly (PHA) (e.g., the PHA 104 of FIG. 1) during a first period of time. In some examples, the first vacuum generator 1002 draws ink into the PHA by driving a pump (e.g., the pump 140 of FIG. 1) coupled to the PHA 104 at a first speed. At block 1104, the example clock 1008 determines whether the first period of time has elapsed. If the example clock 1008 determines that the first period of time has not elapsed, control returns to block 1102 to continue drawing ink into the PHA 104. If the example clock 1008 determines that the first period of time has elapsed, control advances to block 1106.

At block 1106, the example second vacuum generator 1004 evacuated air within the PHA 104 during a second period of time. In some examples, the second vacuum generator 1004 evacuates air within the PHA by driving a pump 140 at a second speed. At block 1108, the example clock 1008 determines whether the second period of time has elapsed. If the example clock 1008 determines that the second period of time has not elapsed, control returns to block 1106 to continue evacuating air within the PHA 104.

If the example clock 1008 determines that the second period of time has elapsed, the example program of FIG. 11 ends.

Figure 12:
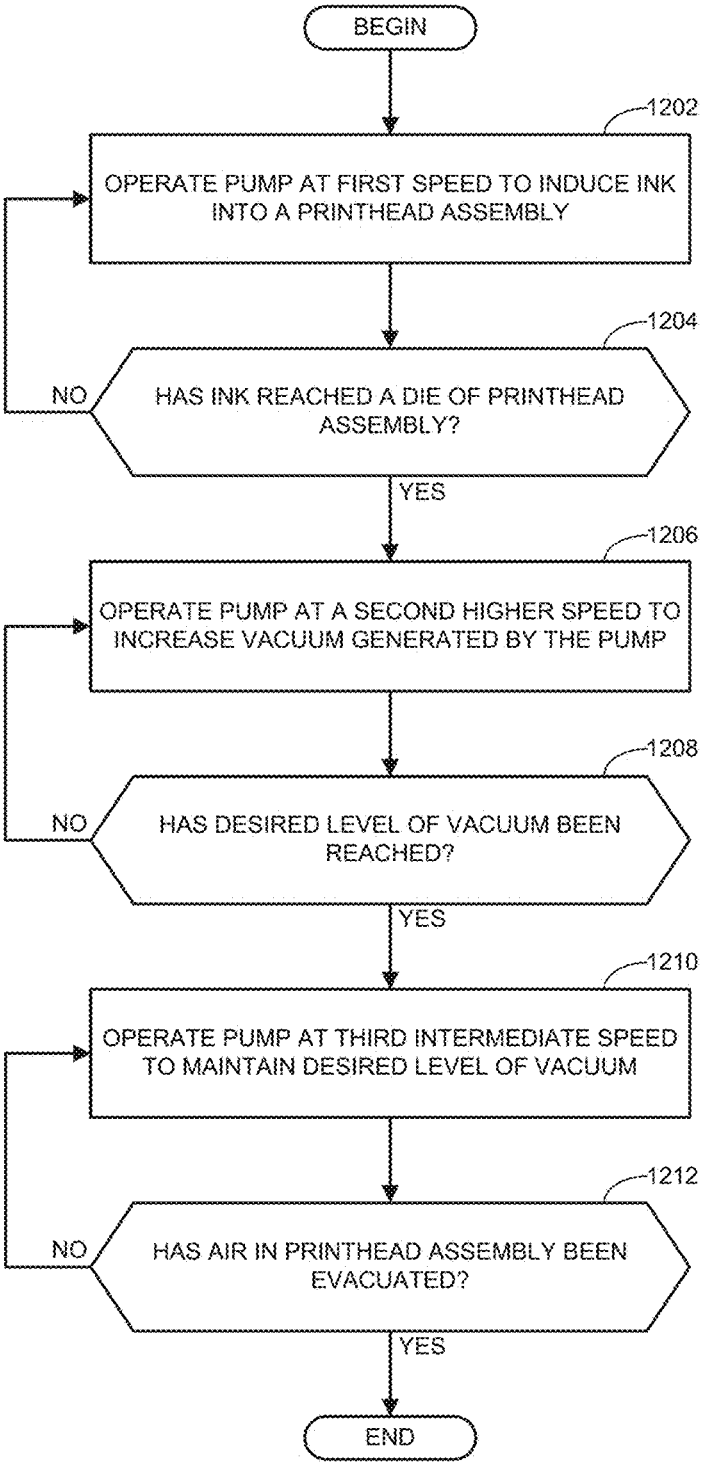

The example program of FIG. 12 begins at block 1202 where the example first vacuum generator 1002 operates a pump (e.g., the pump 140 of FIG. 1) at a first speed to induce ink into a PHA (e.g., the PHA 104 of FIG. 1). At block 1204, the example clock 1008 determines whether the ink has reached a die (e.g., the die 124 of FIG. 1) of the PHA 104. In some examples, the clock 1008 determines whether the ink has reached the die based upon whether a predetermined time has elapsed corresponding to the amount of time it takes for ink to reach the die 124. If the example clock 1008 determines that the ink has not reached the die 124, control returns to block 1202 to continue operating the pump 140 at the first speed. If the example clock 1008 determines that the ink has reached the die 124, control advances to block 1208.

At block 1208, the example vacuum level transitioner 1006 operating the pump at a second higher speed to increase the vacuum generated by the pump 140. At block 1210, the example clock 1008 determines whether a desired level of vacuum has been reached. In some examples, the desired level of vacuum corresponds to a vacuum sufficiently high to create a pressure difference across the die 124 that exceeds the die bubble pressure. In some examples, the clock 1008 determines whether the desired level of vacuum has been reached based upon whether a predetermined time has elapsed. If the example clock 1008 determines that the desired level of vacuum has not been reached, control returns to block 1206 to continue operating the pump 140 at the second higher speed. If the example clock 1008 determines that the desired level of vacuum has been reached, control advances to block 1210.

At block 1210, the example second vacuum generator 1004 operates the pump 140 at a third intermediate speed to maintain the desired level of vacuum. At block 1212, the example clock 1008 determines whether air in the PHA 104 has been evacuated. In some examples, the clock 1008 determines whether the air in the PHA 104 has been evacuated based upon whether a predetermined time has elapsed corresponding to the amount of time it takes for air in the PHA 104 to be drawn out through the die 124. If the example clock 1008 determines that the air in the PHA 104 has not been evacuated, control returns to block 1210 to continue operating the pump 140 at the third intermediate speed. If the example clock 1008 determines that the air in the PHA 104 has been evacuated, the example program of FIG. 12 ends.

Figure 13:
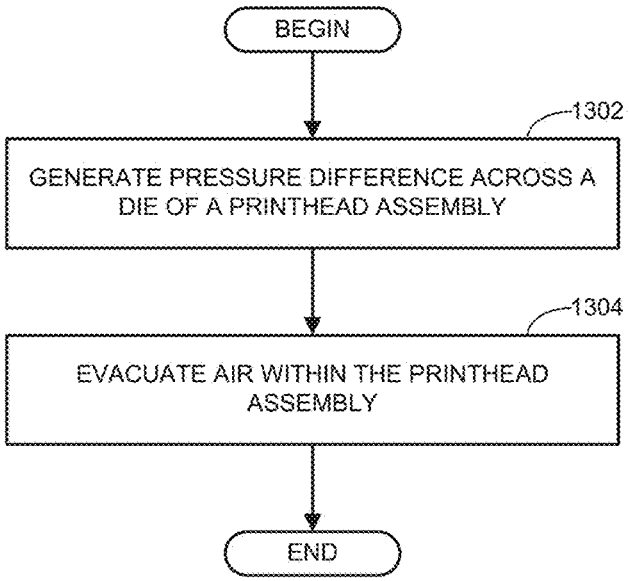

The example program of FIG. 13 begins at block 1302 where the example first vacuum generator 1002 generates a pressure difference across a die (e.g., the die 124 of FIG. 1) of a PHA (e.g., the PHA 104 of FIG. 1). In some examples, the first vacuum generator 1002 generates the pressure difference by driving a pump (e.g., the pump 140 of FIG. 1) coupled to the PHA 104 at a first speed to draw ink into the PHA 104 and down to the die 124. At block 1304, the example second vacuum generator 1004 evacuates air within the PHA 104. In some examples, the second vacuum generator 1004 evacuates air within the PHA by driving the pump 140 at a second speed sufficient to pull air through the die 124. Once the air within the PHA 104 has been evacuated (block 1304), the example program of FIG. 13 ends.

Figure 14:
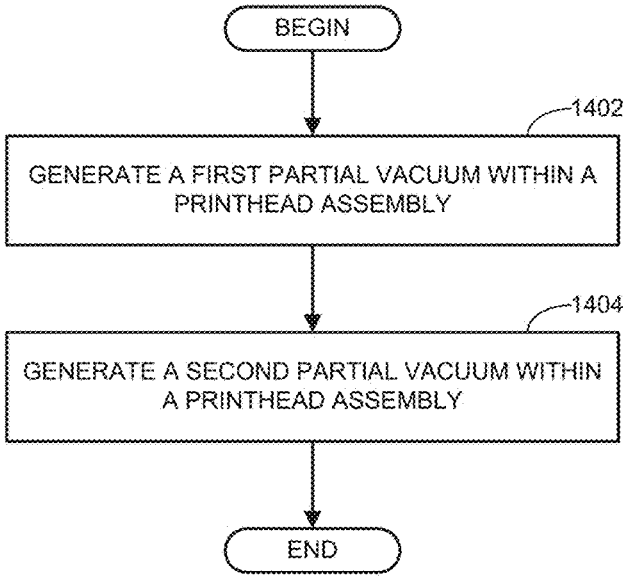

The example program of FIG. 14 begins at block 1402 where the example first vacuum generator 1002 generates a first partial vacuum within a PHA (e.g., the PHA 104 of FIG. 1). In some examples, the first partial vacuum is sufficient to draw ink into the PHA 104 through a filter (e.g., the filter 120 of FIG. 1) at an inlet of the PHA 104 but insufficient to draw air in through the filter 120. At block 1404, the example second vacuum generator 1004 generates a second partial vacuum within the PHA 104. In some examples, the second partial vacuum is sufficient to draw both ink and air out through a die (e.g., the die 124) at an outlet of the PHA 104 but insufficient to produce a vacuum within the PHA 104 that will draw air into the PHA 104 through the filter 120. After the second partial vacuum draws out all or substantially all air from within the PHA 104, the example program of FIG. 14 ends.

Figure 15:
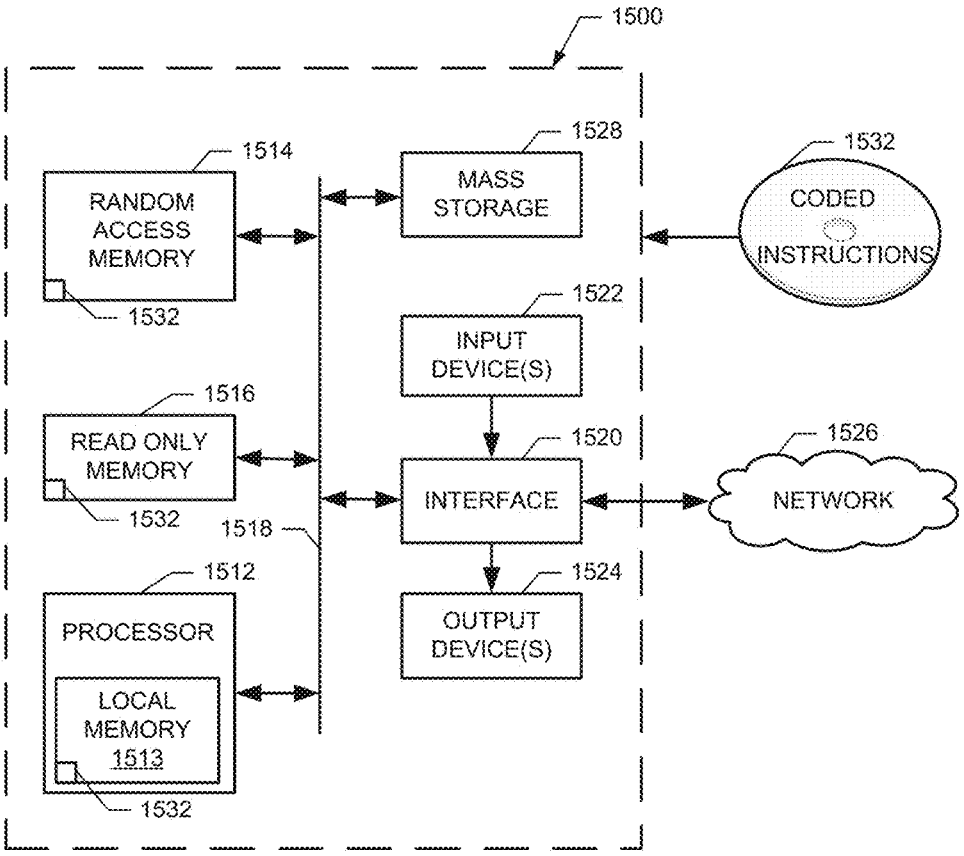
FIG. 15 is a block diagram of an example processor platform capable of executing the example machine readable instructions of FIGS. 11-14 to implement the controller of FIGS. 1 and/or 10.

FIG. 15 is a block diagram of an example processor platform 1500 capable of executing the instructions of FIGS. 11-14 to implement the controller 144 of FIGS. 1 and/or 10. The processor platform 1500 can be, for example, a server, a personal computer, a mobile device (e.g., a cell phone, a smart phone, a tablet such as an iPad™), a personal digital assistant (FDA), an Internet appliance, or any other type of computing device.

The processor platform 1500 of the illustrated example includes a processor 1512. The processor 1512 of the illustrated example is hardware. For example, the processor 1512 can be implemented by one or more integrated circuits, logic circuits, microprocessors or controllers from any desired family or manufacturer.

The processor 1512 of the illustrated example includes a local memory 1513 (e.g., a cache). The processor 1512 of the illustrated example is in communication with a main memory including a volatile memory 1514 and a non-volatile memory 1516 via a bus 1518. The volatile memory 1514 may be implemented by Synchronous Dynamic Random Access Memory (SDRAM), Dynamic Random Access Memory (DRAM), RAMBUS Dynamic Random Access Memory (RDRAM) and/or any other type of random access memory device. The non-volatile memory 1516 may be implemented by flash memory and/or any other desired type of memory device. Access to the main memory 1514, 1516 is controlled by a memory controller.

The processor platform 1500 of the illustrated example also includes an interface circuit 1520. The interface circuit 1520 may be implemented by any type of interface standard, such as an Ethernet interface, a universal serial bus (USB), and/or a PCI express interface.

In the illustrated example, one or more input devices 1522 are connected to the interface circuit 1520. The input device(s) 1522 permit(s) a user to enter data and commands into the processor 1512. The input device(s) can be implemented by, for example, a keyboard, a button, a mouse, a touchscreen, a track-pad, a trackball, isopoint and/or a voice recognition system.

One or more output devices 1524 are also connected to the interface circuit 1520 of the illustrated example. The output devices 1524 can be implemented, for example, by display devices (e.g., a light emitting diode (LED), an organic light emitting diode (OLED), a liquid crystal display, a cathode ray tube display (CRT), a touchscreen, a tactile output device, a light emitting diode (LED), a printer and/or speakers). The interface circuit 1520 of the illustrated example, thus, typically includes a graphics driver card, a graphics driver chip or a graphics driver processor.

The interface circuit 1520 of the illustrated example also includes a communication device such as a transmitter, a receiver, a transceiver, a modem and/or network interface card to facilitate exchange of data with external machines (e.g., computing devices of any kind) via a network 1526 (e.g., an Ethernet connection, a digital subscriber line (DSL), a telephone line, coaxial cable, a cellular telephone system, etc.).

The processor platform 1500 of the illustrated example also includes one or more mass storage devices 1528 for storing software and/or data. Examples of such mass storage devices 1528 include floppy disk drives, hard drive disks, compact disk drives, Blu-ray disk drives, RAID systems, and digital versatile disk (DVD) drives.

The coded instructions 1532 of FIGS. 11-14 may be stored in the mass storage device 1528, in the volatile memory 1514, in the non-volatile memory 1516, and/or on a removable tangible computer readable storage medium such as a CD or DVD.

Although certain example methods, apparatus and articles of manufacture have been disclosed herein, the scope of coverage of this patent is not limited thereto. On the contrary, this patent covers all methods, apparatus and articles of manufacture fairly falling within the scope of the claims of this patent.

What is claimed is:

1. A method comprising:

drawing ink into a printhead assembly by operating a pump in fluid communication with the printhead assembly for a first period of time at a first speed, an amount of ink drawn into the printhead assembly during the first period being sufficient to cover nozzles of a die at an outlet of the printhead assembly; and evacuating air within the printhead assembly by operating the pump for a second period of time after the first period of time at a second speed greater than the first speed.

2. A method as defined in claim 1, wherein the first speed corresponds to a first pressure at the outlet of the printhead assembly, the first pressure being transmitted through the printhead assembly to a first side of a filter at an inlet of the printhead assembly, a difference between the first pressure and a second pressure on a second side of the filter opposite the first side being insufficient to draw air through the filter, the filter coupled to an ink supply.

3. A method as defined in claim 2, wherein the second speed corresponds to a third pressure at the outlet of the printhead assembly, the ink covering the nozzles of the die results in a pressure difference across the die between the third pressure and a fourth pressure within the printhead assembly, and the pressure difference is sufficient to draw air through the nozzles of the die.

4. A method as defined in claim 3, wherein a difference between the fourth pressure and the second pressure is insufficient to draw air through the filter.

5. A method as defined in claim 1, wherein the pump operating at the first speed generates a first vacuum within the printhead assembly sufficient to draw the ink from an ink supply into the printhead assembly without drawing in air.

6. A method as defined in claim 5, wherein the pump operating at the second speed generates a second vacuum at the die that is greater than the first vacuum, the second vacuum sufficient to draw air through the die, wherein the ink covering the nozzles of the die generates a pressure difference across the die to produce a third vacuum within the printhead assembly that is less than the second vacuum, the third vacuum to draw the ink into the printhead assembly without drawing air into the printhead assembly.

7. A method as defined in claim 1, further comprising operating the pump for a third period of time between the first and second periods of time at a third speed greater than the second speed.

8. A method as defined in claim 7, wherein a first level of vacuum generated by the pump during the first period of time is increased to a second level of vacuum during the third period of time, and the second level of vacuum is maintained substantially constant during the second period of time by the pump operating at the second speed.

9. A method as defined in claim 1, wherein the pump transitions from the first period of time to the second period of time without stopping.

10. A method as defined in claim 1, wherein the printhead assembly is dry before the first period of time.

11. A tangible machine readable storage medium comprising instructions stored thereon that, when executed, cause a machine to at least:

generate a pressure difference across a die of a printhead assembly by drawing ink from an ink supply into the printhead assembly and onto the die, the ink drawn into the printhead assembly based on a first reduced pressure produced via a priming pump in fluid communication with the die; and evacuate air from the printhead assembly after the ink is drawn onto the die, the air evacuated from the printhead assembly based on a second reduced pressure produced via the priming pump, the second reduced pressure lower than the first reduced pressure.

12. A storage medium as defined in claim 11, wherein the first reduced pressure is to generate a pressure difference across a filter of the printhead assembly that is less than a bubble pressure of the filter.

13. A storage medium as defined in claim 11, wherein the pressure difference across the die produces a third reduced pressure within the printhead assembly that is higher than the second reduced pressure, the third reduced pressure to generate a pressure difference across a filter of the printhead assembly that is less than a bubble pressure of the filter.

14. A storage medium as defined in claim 13, wherein a difference between the second reduced pressure and the third reduced pressure is greater than a bubble pressure at the die.

15. A storage medium as defined in claim 11, wherein a difference between the first reduced pressure and a pressure of the ink supply is insufficient to draw air through a filter fluidly coupling the printhead assembly to the ink supply.

16. An apparatus comprising:

a printhead assembly having a filter at an inlet and a die at an outlet, the filter to fluidly couple the printhead assembly to an ink supply, the die to be in fluid communication with the filter and having nozzles to define the outlet of the printhead assembly;

a pump in fluid communication with the outlet of the printhead assembly;

a first vacuum generator to drive the pump at a first speed corresponding to a first partial vacuum, the first partial vacuum to draw ink from the ink supply into the printhead assembly to wet out the die of the printhead assembly; and a second vacuum generator to drive the pump at a second speed greater than the first speed after the die is wetted out, the second speed corresponding to a second partial vacuum greater than the first partial vacuum to evacuate air from within the printhead assembly.

17. An apparatus as defined in claim 16, further comprising a vacuum level transitioner to drive the pump at a third speed greater than the second speed to transition the first partial vacuum to the second partial vacuum.

18. An apparatus as defined in claim 16, wherein the first partial vacuum is insufficient to pull air from the ink supply through the filter.

19. An apparatus as defined in claim 16, wherein the wetted out die produces a third partial vacuum within the printhead assembly that is less than the second partial vacuum, the third partial vacuum insufficient to pull air from the ink supply through the filter.

* * * * *